US009387523B2

(12) United States Patent
Soellner

(10) Patent No.: US 9,387,523 B2
(45) Date of Patent: Jul. 12, 2016

(54) APPARATUS AND METHOD OF RINSING PLASTICS MATERIAL CONTAINERS

(75) Inventor: Hannelore Soellner, Holzheim Am Forst (DE)

(73) Assignee: KRONES AG, Neutraubling (DE)

( * ) Notice: Subject to any disclaimer, the term of this patent is extended or adjusted under 35 U.S.C. 154(b) by 970 days.

(21) Appl. No.: 13/490,664

(22) Filed: Jun. 7, 2012

(65) Prior Publication Data

US 2012/0312330 A1 Dec. 13, 2012

(30) Foreign Application Priority Data

Jun. 10, 2011 (DE) ..... 10 2011 106 134

(51) Int. Cl.

| | |
|---|---|
| ***B08B 9/00*** | (2006.01) |
| ***B08B 9/28*** | (2006.01) |
| ***B08B 5/02*** | (2006.01) |
| ***B08B 5/04*** | (2006.01) |
| ***B08B 9/32*** | (2006.01) |
| ***B08B 9/34*** | (2006.01) |

(52) U.S. Cl.

CPC . *B08B 9/286* (2013.01); *B08B 5/02* (2013.01); *B08B 5/04* (2013.01); *B08B 9/32* (2013.01); *B08B 9/34* (2013.01)

(58) Field of Classification Search

None

See application file for complete search history.

(56) References Cited

U.S. PATENT DOCUMENTS

| | | | | |
|---|---|---|---|---|
| 4,208,761 | A | 6/1980 | Ionescu | |
| 4,727,614 | A | 3/1988 | Swistun | |
| 5,487,200 | A | 1/1996 | Herzog | |
| 5,957,264 | A | 9/1999 | Carey | |
| 6,173,827 | B1 | 1/2001 | Carey | |
| 6,209,705 | B1 | 4/2001 | Drewitz | |
| 6,347,637 | B1 * | 2/2002 | Musha et al. | 134/64 R |
| 2003/0015223 | A1 | 1/2003 | Jacksier et al. | |
| 2003/0115710 | A1 | 6/2003 | Choi | |
| 2010/0037986 | A1 * | 2/2010 | Neumann et al. | 141/91 |

FOREIGN PATENT DOCUMENTS

| | | |
|---|---|---|
| DE | 4425219 | 1/1996 |
| DE | 29903939 | 4/2000 |

OTHER PUBLICATIONS

EPO machine translation for DE 29903939, retrieved from http://worldwide.espacenet.com/publicationDetails/description?CC=DE&NR=29903939U1&KC=U1&FT=D&ND=3&date=20000316&DB=worldwide.espacenet.com&locale=en_EP on Jun. 25, 2015.*

Office Action from the European Patent Office in the corresponding priority application 12 17 1316, mailed Feb. 10, 2012.

* cited by examiner

*Primary Examiner* — Eric Golightly

(74) *Attorney, Agent, or Firm* — Greer, Burns & Crain, Ltd.

(57) ABSTRACT

An apparatus for rinsing plastics material containers, with a conveying device which conveys the plastics material containers along a pre-set conveying path, with a plurality of spraying devices which act upon an inner space of the plastics material containers with a gaseous medium and which are designed to be movable at least locally with the plastics material containers, with a reservoir for the gaseous medium and at least one connecting line by way of which the reservoir is connected in terms of flow to the spraying devices. The apparatus has an ionizing unit which is arranged between the reservoir and the spraying devices and which ionizes centrally the gaseous medium arriving at the spraying devices.

12 Claims, 5 Drawing Sheets

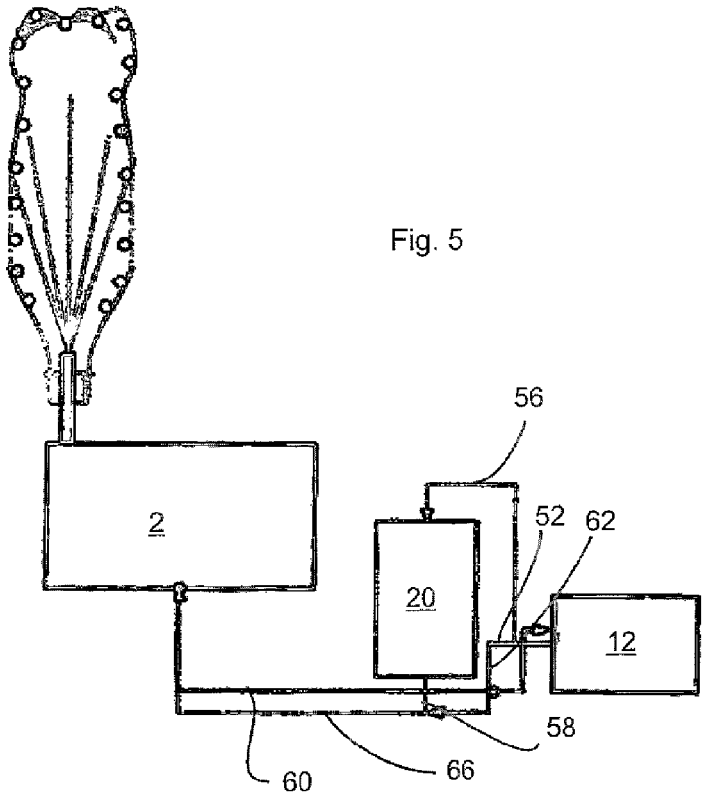
Fig. 5
Fig. 6
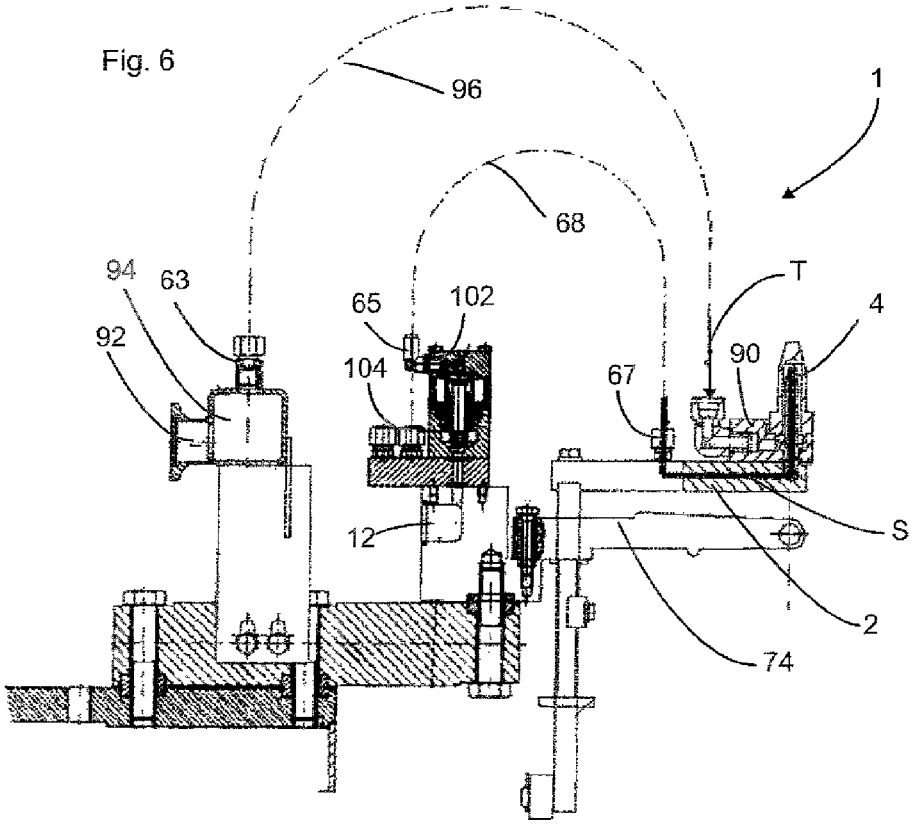

APPARATUS AND METHOD OF RINSING PLASTICS MATERIAL CONTAINERS

BACKGROUND

The present invention relates to an apparatus and a method of rinsing plastics material containers. In the sector of the beverage production industry widely varying methods are known which are employed to clean and, in particular, to rinse plastics material containers. In this case, in particular, plastic bottles, i.e. for example PET bottles, plastics material sheets or plastics material closures, have the special feature that they are electrostatically charged by friction. This charging leads to particles of dust and also for example residues of Styropor or cardboard packaging from the bottles, plastics material closures and so on being attracted and remaining adhering. These particles cannot be removed even by slight shaking and/or blowing with untreated air.

Methods are therefore known from the prior art in which these plastics material containers are acted upon with ionized air in order to compensate this charging so as to be able to remove particles more easily from the plastics material containers in this way. It is thus possible for example for air produced by a compressor to be supplied by way of a sterile air filter to a rinser by way of a valve cluster and after that to a rotary media distributor and a media duct of a corresponding rinsing nozzle. After that, the air can pass by way of a bracket support to the ionization units. This procedure, however, does not allow rinsing of the bottles with liquids and ionized air, since short circuits in the electronics can occur in the event of the liquid coming into contact with the ionization units. It is not possible for the rinsing unit itself to be cleaned with liquids either on the outside or on the inside in this way.

A container conveying system is known from U.S. Pat. No. 6,209,705 B1. In this case the container conveying system has a first station, which introduces ionized gas into the containers, and a second station, which removes dirt from the containers. In this case the ionized air is produced only in the nozzles themselves.

EP 0 895 816 A1 describes an apparatus for the treatment or cleaning of tubular bodies. In this case a central air ionizing unit is provided which supplies ionized air by way of a line to a plurality of nozzles. More precisely, plastics material preforms are treated by this apparatus.

An apparatus for cleaning bottles is known from DE 102 58 208 A1. In this case too, air is converted from an ionized state into air in a neutral state and air neutralized by ionization is blown into the bottles.

A method and an apparatus for blowing out pre-forms of plastics material are likewise known from DE 101 40 906 A1. In this case the crude pre-forms with an open and a closed end are blown out by means of ionized air, in which case the ionized air in the vicinity of the closed end is conveyed into the interior of the pre-forms in order to achieve an advantageous rinsing effect in this way.

In the case of ionization units of this type known from the prior art, the oncoming air flows through the ionization nozzle and the latter has at its centre a metallic needle running to a point and an outer ring which is placed on the earthing of the machine. The air is now ionized on account of the high voltage which can be for example between 3 and 4 kV and which is produced in this case by a transformer. In this way, the conductivity of the air is increased. PET bottles are charged electrostatically on the basis of their method of production, i.e. a blow moulding procedure of the PET bottles and also of the conveying, such as for example an air conveyor. This charging drains away on account of the conductivity which is produced by the ionization of the air.

SUMMARY

The object of the present invention is therefore to provide an apparatus and a method which will simplify such a cleaning or even ionization of the containers.

An apparatus according to the invention for rinsing plastics material containers has a conveying device which conveys the plastics material containers along a pre-set conveying path as well as a plurality of spraying devices which act upon an inner space of the plastics material containers with a gaseous medium and which are designed to be movable at least locally with the plastics material containers. In addition, the apparatus has a reservoir for the gaseous medium and at least one connecting line by way of which the reservoir is connected in terms of flow to the spraying devices.

According to the invention the apparatus has an ionizing unit which is arranged between the reservoir and the spraying devices and which ionizes centrally the gaseous medium arriving at the spraying devices.

A reservoir is to be understood as being any device in which the aforesaid air can be stored. In addition, this reservoir can be a compressor which makes available gaseous medium which is under pressure. In contrast to the prior art, it is thus proposed that a central ionizing unit should be provided which supplies the individual movable nozzles. On account of the movement of the nozzles with the containers a longer and efficient blowing out of the inner space of the containers can be achieved. In this way, it would be possible for example for both the nozzles and the gripping elements which guide the containers to be arranged on the same carrier, such as for example on a carrier wheel. It is therefore preferable for the conveying device to be a conveying wheel. It is preferable for the movement of the spraying devices to be coupled at least locally and, in a particularly preferred manner, during the entire rinsing procedure, to the movement of the containers. It is therefore advantageous for the spraying devices likewise to be arranged in a movable manner along the conveying path of the containers. In this way, the spraying devices can be mounted or arranged on the conveying device which also conveys the containers. It would also be possible, however, for the spraying devices to move at a different speed and/or in a different direction from the containers.

In this way for example, air produced by a compressor (and which is preferably dry and free from oil) can be supplied to the rinser by way of an optional sterile air filter. This supply can advantageously be supplied to a rotary media distributor and a media duct in this case by way of a valve cluster which in a particularly preferred manner contains shut-off devices and sensor means.

The ionization unit, which ionizes the air in a preferably continuous manner (in line), can preferably be situated between the aforesaid supply, i.e. the valve cluster, and the rotary distributor mentioned. After that, the air can arrive at the treatment nozzles (for example by way of the clamp carriers).

In the case of a further advantageous embodiment, the spraying devices are movable with respect to the containers in the longitudinal direction of the containers and they can be introduced into the latter in this way. In this case it would be possible for the spraying devices to be moved in the longitudinal direction of the containers but it would also be possible for the containers to be moved in their longitudinal direction. In this case this movement can be carried out for example by way of a guide cam which is arranged in a stationary manner, but it would also be possible for the individual ionization units to be moved by way of servo drives or other electric-motor, hydraulic or pneumatic drives.

In the case of a further advantageous embodiment, the ionizing unit is made stationary. In this way, the ionizing unit itself is preferably arranged in a stationary or static manner and the spraying devices move with respect to it.

In the case of a further advantageous embodiment, the apparatus has a distributor unit and, in particular, a rotary distributor in order to distribute the gaseous medium starting from the ionizing unit to the spraying devices. In this way, it is preferable for the spraying devices to be arranged on a rotatable carrier.

In the case of a further advantageous embodiment, a first valve device is arranged in a connecting line between the reservoir and the ionizing unit. An air supply from the reservoir to the ionizing unit can be interrupted by means of this ionizing unit. This is advantageous in order to allow the lines also to be cleaned with liquids without the ionizing unit being damaged during this.

By means of the invention, it is also possible for the containers to be rinsed both with liquids and with ionized air, since no contact occurs between the liquid and the ionizing unit. In this case it is advantageous, however, for there to be no vacuum extraction in the region of the treatment with liquid. The rinsing unit or the rinser is thus also capable of being cleaned (wet) with liquids on the outside and the inside. This cleaning is advantageously capable of being carried out by by-passing the ionizing unit if the first valve device mentioned above is provided.

In the case of a further advantageous embodiment, a second valve device is arranged in a connecting line between the ionizing unit and the spraying devices. In this way, the ionizing unit can be separated off, in particular during a wet cleaning, by these two valve devices being closed.

In the case of a further advantageous embodiment, the apparatus has a connecting line which connects the reservoir to the spraying devices whilst by-passing the ionizing unit. This connecting line is used in particular for cleaning the individual components of the apparatus whilst by-passing the ionizing unit.

In the case of a further advantageous embodiment, the connecting line has a first branch and a second branch which are capable of being connected in terms of flow in each case to the ionizing unit, and it is preferable for the connecting line to have a further valve device between these branches. If this further valve device is shut off and the valve devices mentioned above are opened, a medium, such as in particular air, passes exclusively by way of the ionizing unit from the reservoir to the individual spraying devices.

In the case of a further advantageous embodiment, the apparatus has at least one heating device which heats the gaseous medium. It is advantageous for this heating device to be connected in series with the ionizing unit, so that the air passes either first through the heating unit and then through the ionizing unit or first through the ionizing unit and then through the heating unit.

In the case of a further advantageous embodiment, the apparatus has a further rinsing unit which is used for rinsing the plastics material containers with a liquid medium. This further rinsing unit can be arranged in this case parallel to the spraying with liquid, but it would also be possible for this liquid rinsing medium to pass through the same spraying devices through which the gaseous medium can also pass with the ionized air.

In this case it is advantageous for a supply line for the liquid to be separated completely from the ionizing unit, so that in this way it is possible to prevent the ionizing unit itself from being acted upon with liquid. The aforesaid rinsing nozzles in this case can be arranged in a stationary manner or can move jointly with the containers.

In the case of a further advantageous embodiment the apparatus has an extraction device in order to draw a gaseous medium out of the containers. In this case it is possible for the extraction device to open into the respective spraying devices. In addition, it is possible for the extraction device to have a central vacuum source which draws the gaseous medium through the individual spraying devices or out of the containers generally. In this case the vacuum can likewise be drawn off by way of a rotary distributor. The liquid rinsing agent mentioned above can likewise be supplied by way of the aforesaid rotary distributor.

In this way, the invention can be implemented for a multiplicity of fields of application. Thus, by way of example, for a single-channel rinser with an electronic and/or mechanical valve control and preferably a dipping nozzle if no extraction of the particles is desired. In addition, an application for a two-channel rinser with an electronic and/or mechanical valve control and preferably also a dipping nozzle is possible if an extraction of the particles by vacuum is additionally desired.

In addition, the design of a two-channel rinser with an electronic and/or mechanical valve control and a dipping nozzle is also possible in which the container is treated with ionized air and liquid medium and without vacuum extraction. Finally, the design in the form of a three-channel rinser is also possible which likewise advantageously has an electronic and/or mechanical valve control as well as a dipping nozzle, in which a vacuum capable of being turned off is also present in addition to treatment of the containers with ionized air and liquid medium.

The plastics material containers are also understood in this case to be plastics material closures and plastics material containers generally in addition to plastic bottles or plastics material pre-forms. If closures or containers are pre-cleaned with ionized air before a treatment with disinfectant solution, the cleaning action of the disinfectant solution is increased. On account of the reduced adhesion of particles, the particles and thus possibly also micro-organisms concealed below these particles can be removed. In this way, the contact ratio of the disinfectant medium to the carrier is improved, which can be for example a container or closure.

On account of the reduced adhesion of particles and the micro-organisms connected to them, the rinsing action is improved and, as a result, the contact between the carrier and the disinfectant solution is made possible and also improved. In addition, it would also be possible for packaging films such as for example shrink packaging or the like to be treated with the apparatus according to the invention.

The present invention additionally relates to a method of rinsing plastics material containers, in which the plastics material containers are conveyed along a pre-set conveying path by means of a conveying device and are acted upon with a gaseous medium on their inner wall by means of a plurality of spraying devices at least locally during this conveying. In this case the spraying devices are moved at least for a time—in particular along the conveying path and preferably also in the direction of movement of the containers—and are supplied with the gaseous medium from a common reservoir.

According to the invention, the gaseous medium arriving at the spraying devices is ionized by a centrally ionizing unit.

It is thus also proposed with respect to the method that a central ionizing unit is provided which is, in particular, arranged in a stationary manner and which supplies the individual spraying devices. It is preferable in this case for the ionizing unit to be arranged at a distance from the individual spraying devices and, in a particularly preferred manner, for a supply device and a gas line to be provided in each case between the ionizing unit and the individual spraying devices.

BRIEF DESCRIPTION OF THE DRAWINGS

Further advantages and embodiments are evident from the accompanying drawings. In the drawings

FIG. 5 is an illustration in the manner of a block diagram of an apparatus according to the invention in a further embodiment;

FIG. 6 is a diagrammatic illustration of an apparatus according to the invention;

DETAILED DESCRIPTION

Figure 1:
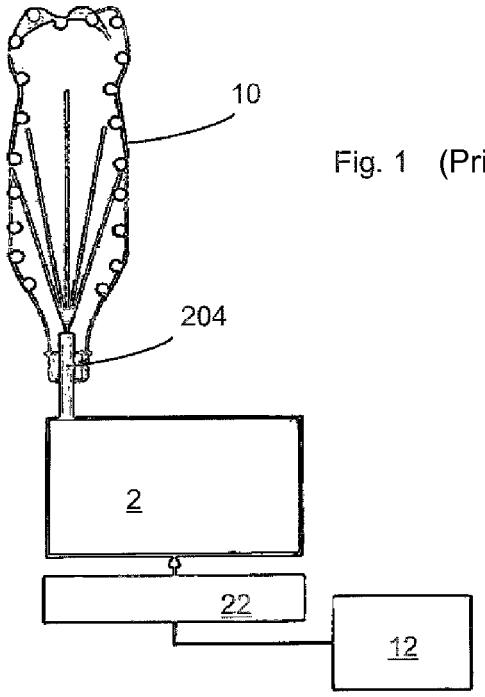
Fig. 1 (Prior Art)
FIG. 1 is an illustration in the manner of a block diagram of an apparatus according to the prior art.

FIG. 1 is an illustration in the manner of a block diagram of an apparatus for rinsing plastics material containers 10 according to the prior art. In this case this apparatus has a reservoir 12 which can be for example a valve cluster. Starting from this valve cluster the gaseous medium passes by way of a rotary media distributor 22 to the conveying device 2 which can be a turntable for example. A plurality of stressing devices or rinsing units 204, which rinse the containers 10 from the inside, are arranged on this turntable. In this case these spraying devices 204 also have in each case ionizing units, as described above, so that in this case a plurality of ionizing units of this type are provided.

Figure 2:
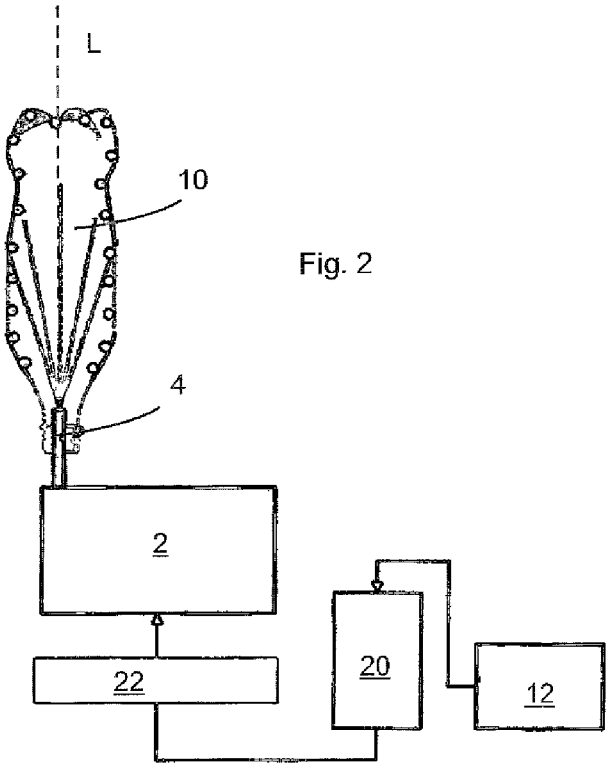
FIG. 2 is an illustration in the manner of a block diagram of an apparatus according to the invention.

FIG. 2 shows roughly diagrammatically an apparatus according to the invention for rinsing containers. In this case too a reservoir 12, in this case in the form of a valve cluster, is provided, from which the gaseous medium first reaches an ionizing unit 20 and from there by way of the rotary distributor 22 reaches the conveying device 2. This conveying device 2 has in this case a plurality of spraying devices 4, which act upon the containers 10 with ionized air in each case. These spraying devices, however, no longer have in this case their own ionizing devices, but are already supplied—as mentioned above—with ionized air. The ionizing unit 20 is made stationary here and only the rotary media distributor 22 ensures that the gaseous medium is conveyed to the rotating containers or rinsing devices respectively.

Figure 3:
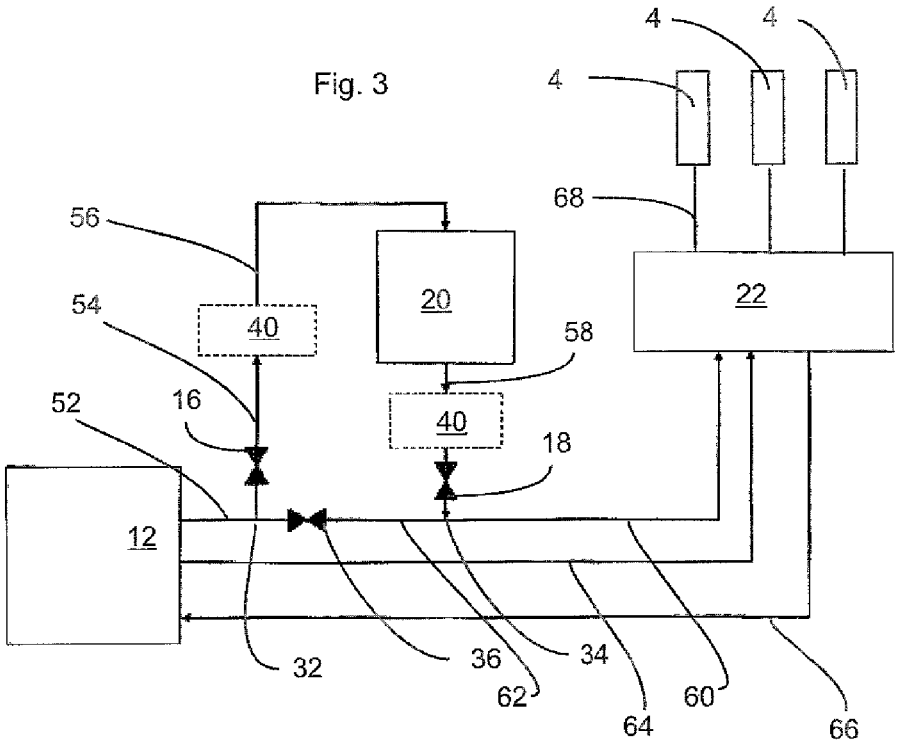
FIG. 3 is an illustration in the manner of a block diagram of an apparatus according to the invention with an illustration of media courses.

FIG. 3 is a circuit diagram of an apparatus according to the invention. In this case the reservoir 12 is again shown, from which sterile air is delivered by way of a line portion 52. In a working operation one valve 16 is opened and one valve 36 is closed and the sterile air passes by way of the line portion 54 and an optional heating device and a line portion 56 to the ionizing unit 20. It would also be possible in this case for the heating device to be arranged downstream with respect to the ionizing unit 20, as indicated in FIG. 3.

Starting from the ionizing unit 20 the now ionized gaseous medium 58 passes by way of a valve 18 opened in this case to the rotary media distributor 22 and from there by way of supply lines 68 to the individual spraying devices 4 in each case.

In a rinsing operation, the two valves 16 and 18 are closed and the valve 36 is opened. In this case, a CIP or cleaning medium passes directly, starting from the reservoir 12, by way of the line 52 and the line portion 62 and 60 to the rotary media distributor 22 and thus again by way of the supply lines 68 to the spraying devices 4. In this way, it is possible for the individual line portions 52, 62, 60 and 68 to be capable of being cleaned, without the ionizing unit 20 also coming into contact with a (liquid) cleaning medium in this case. In addition, the air heaters or heating devices 40 respectively do not come into contact with the cleaning medium in this case. It would also be possible, however, for the heating devices 40 to be capable of being arranged if necessary in such a way that they can also be jointly cleaned.

The reference number 64 relates to a further line device, by way of which a liquid treatment medium (in particular for rinsing the containers) can be supplied in turn—starting from a reservoir—to the rotary media distributor 22 or to the carrier device (not shown) respectively.

The reference number 66 designates a return line for the above-mentioned CIP medium which is supplied by way of the lines 52, 62 and 60.

Figure 4:
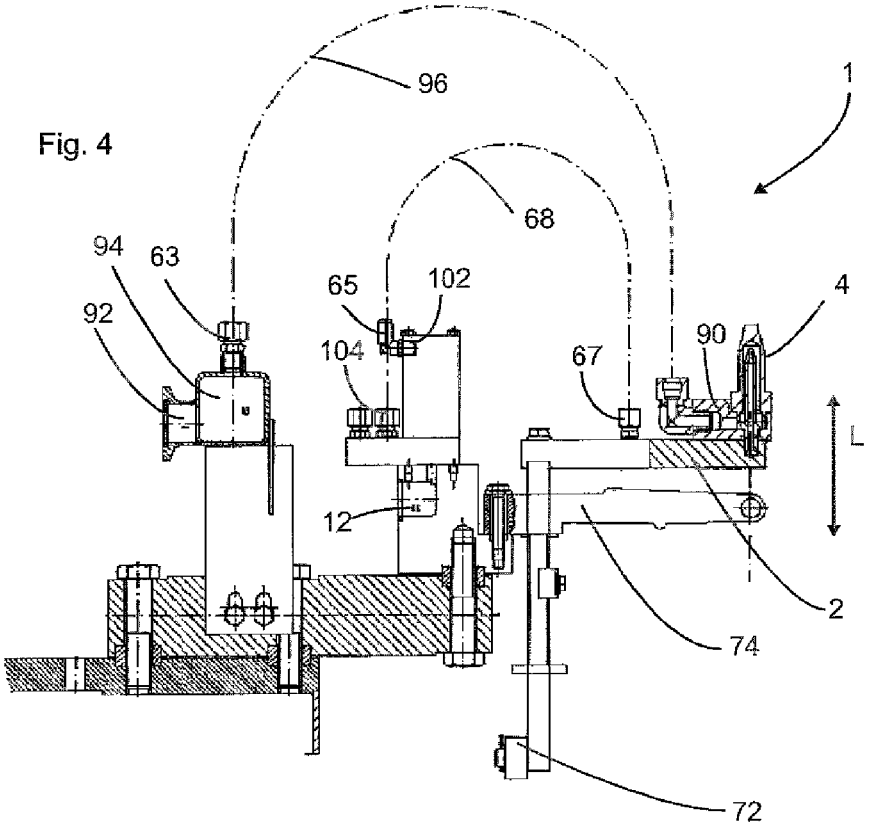
FIG. 4 is a diagrammatic illustration of an apparatus according to the invention.

FIG. 4 is a further illustration of an apparatus 1 according to the invention. In this case, it is evident that a vacuum unit is additionally provided which is used for the extraction of air out of the container (not shown). For this purpose, a vacuum source (not shown) can be attached to a socket 92 and in this way an annular duct 94 already arranged in a rotating manner can be acted upon with this vacuum. The reference number 63 relates to a socket for the vacuum source and the reference number 96 relates to a connecting line in order to transmit the vacuum to the spraying devices 4. Ionized air is supplied to the pouring device 4 by way of the line portion 68. The reference number 72 designates a cam roller with which the spraying device 4 can be raised and lowered as a whole. In this way, it is possible for the spraying device 4 to be introduced into the container (not shown) in a direction L which at the same time is a longitudinal direction of the latter. In this way, an improved rinsing of the inner space of the container is possible. The reference number 90 designates an attachment block by way of which media can be supplied to the spraying device 4.

The reference number 74 designates a pivot axis or pivot shaft by which the containers can be pivoted, for example into an overhead position.

The reference number 12 again designates in this case a reservoir for ionized air, such as for example an annular duct, in which the ionized air is present. The reference number 102 relates to control valves which can control the supply of the ionized air starting from a socket 65 to a further socket 67.

FIG. 5 shows a further embodiment of an apparatus according to the invention. In this embodiment a CIP return 60 is again provided as well as also a by-pass in the form of a line device 62 which by-passes the ionizing unit 20 for cleaning purposes.

FIG. 6 is a corresponding illustration of the apparatus 1. In this case too, as in FIG. 3, the vacuum socket and also the sockets 63 and 67 are evident. The reference number 67 again designates the air socket in order to supply the ionized gas or the ionized air respectively to the spraying device along the course S. The advance for the ZIP medium also takes place along the line S and the return for the medium along the line T. This means that the actuation for the ionized air is used for the advance of the ZIP medium and the vacuum duct is used for the return. In this way, the ZIP advance is at the same time the supply of the air in the operating mode and the vacuum duct acts as the ZIP return in the cleaning. In this way, a complete cleaning of the ducts is possible. The valve 102 is used for changing the cleaning media, in particular in a cleaning operation.

Figure 7:
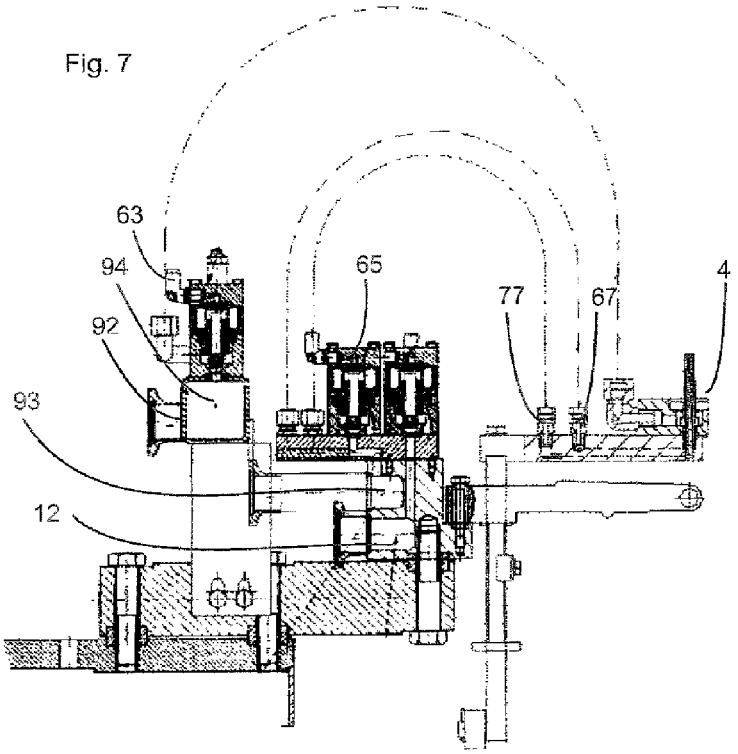
FIG. 7 is a further diagrammatic illustration of an apparatus according to the invention in a further embodiment.

FIG. 7 is a further illustration of the apparatus according to the invention. In the case of this apparatus a vacuum supply 92, 94 is likewise again provided, as in the preceding figures, as well as also a supply with ionized air. In addition, a control means for a liquid medium such as for example a rinsing medium is again provided here. This rinsing medium is likewise supplied in this case by way of a socket 77 to the spraying device and the supply of ionized air and also of rinsing media into the container (not shown) can be implemented in each case by way of suitable actuating means 65 and 102.

Figure 8:
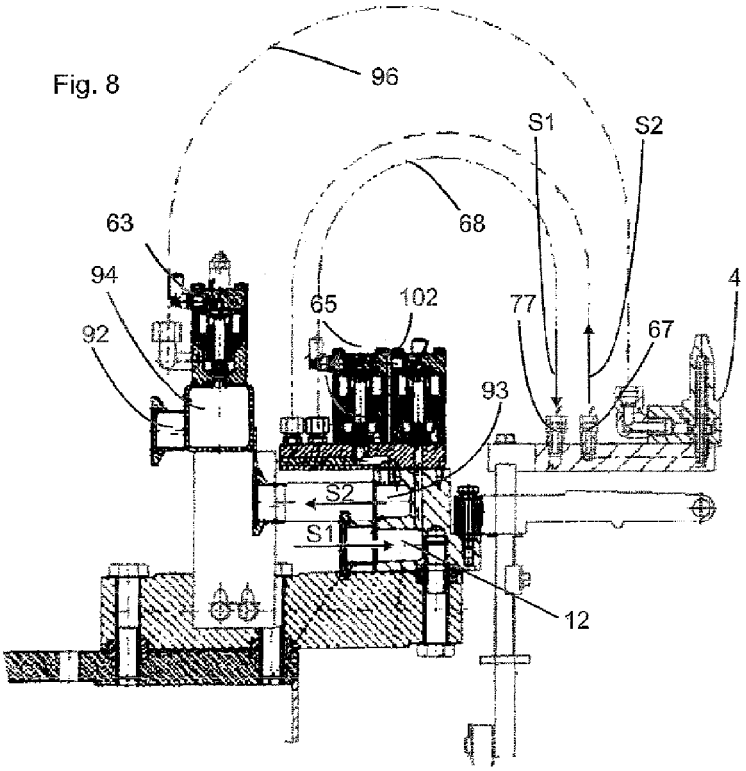
FIG. 8 is a diagrammatic illustration of an apparatus according to the invention in a further embodiment.

FIG. 8 shows the apparatus according to FIG. 7, in particular a cleaning circuit, in which case the flow paths S1 and S2 are again illustrated for the cleaning circuit. The supply of a ZIP medium in this case takes place in the direction of the arrow S1 and the removal of the ZIP medium takes place in the direction of the arrow S2. The reference number 93 again designates a media duct and the reference number 12 designates the above-mentioned reservoir for the ionized air.

Figure 9:
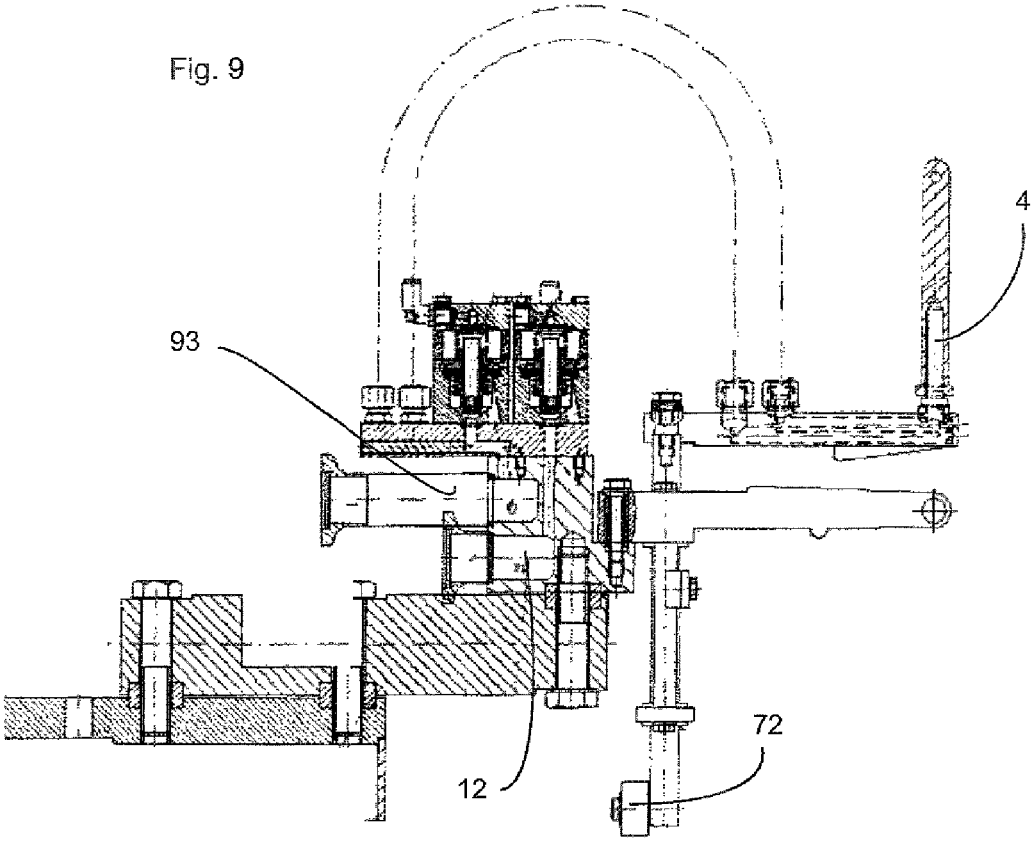
FIG. 9 is a further diagrammatic illustration of an apparatus according to the invention in a further embodiment.

FIG. 9 again illustrates the apparatus according to FIG. 8, in which case the media ducts or reservoirs 12 and 93 for the ionized air and also for the liquid medium may again be seen. In contrast to the apparatus shown in FIG. 8, no vacuum duct is provided in the case of the apparatus shown in FIG. 9, i.e. the extraction of air from the container does not take place here.

The Applicants reserve the right to claim all the features disclosed in the application documents as being essential to the invention, insofar as they are novel either individually or in combination as compared with the prior art.

The invention claimed is:

1. An apparatus for rinsing plastics material containers, comprising:

a conveying device which conveys the plastics material containers along a pre-set conveying path, said conveying device including a plurality of spraying devices which act upon an inner space of the plastics material containers with a gaseous medium and are to be movable at least locally with the plastics material containers;

a reservoir for the gaseous medium and at least one connecting line by way of which the reservoir is connected in terms of flow to the spraying devices;

an ionizing unit arranged between the reservoir and the spraying devices and which ionizes centrally the gaseous medium arriving at the spraying devices; and a by-pass in the form of a connecting line which by-passes the ionizing unit, wherein a cleaning medium passes directly from the reservoir to the spraying devices.

2. The apparatus according to claim 1, wherein the ionizing unit is made stationary.

3. The apparatus according to claim 1, wherein the apparatus has a rotary distributor configured to distribute the gaseous medium from the ionizing unit to the spraying devices.

4. The apparatus according to claim 1, wherein a first valve device is arranged in a connecting line between the reservoir and the ionizing unit.

5. The apparatus according to claim 4, wherein a second valve device is arranged in a connecting line between the ionizing unit and the spraying devices.

6. The apparatus according to claim 1, wherein the connecting line has a first branch and a second branch which are capable of being connected in terms of flow in each case to the ionizing unit.

7. The apparatus according to claim 1, wherein the apparatus has at least one heating device which heats the gaseous medium.

8. The apparatus according to claim 1, wherein the apparatus has a rinsing unit for rinsing the plastics material containers with a liquid medium.

9. The apparatus according to claim 1, wherein the apparatus has an extraction device in order to draw a gaseous medium out of the containers.

10. An apparatus for rinsing plastics material containers, comprising:

a conveying device which conveys the plastics material containers along a pre-set conveying path, said conveying device including a plurality of spraying devices which move in a longitudinal direction into and out of the plastics material containers and act upon an inner space of the plastics material containers with a gaseous medium;

a reservoir for the gaseous medium and at least one connecting line by way of which the reservoir is connected in terms of flow to the spraying devices;

an ionizing unit arranged between the reservoir and the spraying devices and which ionizes centrally the gaseous medium arriving at the spraying devices;

a by-pass in the form of a connecting line which by-passes the ionizing unit; and a guide cam that is stationary and configured for moving at least one of the plurality of spraying devices.

11. The apparatus of claim 10, further comprising one of: a servo-drive, an electric motor, a hydraulic drive or a pneumatic drive, which are each configured for moving said ionizing unit.

12. An apparatus for rinsing plastics material containers, comprising:

a conveying device which conveys the plastics material containers along a pre-set conveying path, said conveying device including a plurality of spraying devices which move in a longitudinal direction into and out of the plastics material containers and act upon an inner space of the plastics material containers with a gaseous medium;

a reservoir for the gaseous medium and at least one connecting line by way of which the reservoir is connected in terms of flow to the spraying devices;

an ionizing unit arranged between the reservoir and the spraying devices and which ionizes centrally the gaseous medium arriving at the spraying devices;

a servo-drive, an electric motor, a hydraulic drive or a pneumatic drive, which are each configured for moving said ionizing unit; and a by-pass in the form of a connecting line which by-passes the ionizing unit.

* * * * *